US005271529A

United States Patent [19]

Stuber

[11] Patent Number: 5,271,529

[45] Date of Patent: Dec. 21, 1993

[54] APPARATUS FOR DISPENSING TOOTHPASTE FROM A FLEXIBLE TUBE

[76] Inventor: Ivan L. Stuber, 1026 N. Lightner, Wichita, Kans. 67208

[21] Appl. No.: 994,286

[22] Filed: Dec. 21, 1992

[51] Int. Cl.[5] ..... B65D 35/28

[52] U.S. Cl. ..... 222/103

[58] Field of Search ..... 222/103

[56] References Cited

U.S. PATENT DOCUMENTS

| | | | |
|---|---|---|---|
| 2,489,940 | 11/1949 | Trotta | 222/103 |
| 2,568,286 | 9/1951 | Littlefield | 222/103 |
| 2,589,058 | 3/1952 | Corson et al. | 222/103 X |
| 2,597,273 | 5/1952 | Scott | 222/103 |
| 2,613,853 | 10/1952 | Halvorsen | 222/103 |
| 2,667,287 | 1/1954 | Cook | 222/103 X |
| 2,801,770 | 8/1957 | Hornsby | 222/103 |
| 3,003,665 | 10/1961 | Peters | 222/103 X |
| 4,015,750 | 4/1977 | Wilston | 222/103 |

FOREIGN PATENT DOCUMENTS

| | | | |
|---|---|---|---|
| 1083673 | 1/1955 | France | 222/103 |

*Primary Examiner*—Kevin P. Shaver
*Attorney, Agent, or Firm*—John Wade Carpenter

[57] ABSTRACT

A toothpaste dispenser having a top with a centrally disposed elongated opening; a pair of sides secured to the top, a rear wall secured to the sides, and a first end wall secured to the top and to the sides and to the rear wall. The first end wall has an opening wherethrough a neck of a toothpaste container may pass. The toothpaste dispenser also has a second end wall removably engaged to the top, the sides, and to the rear wall for removing the second end wall to dispose a toothpaste container into the toothpaste dispenser. A lug member is provided for slidably passing through the elongated opening. The lug member interconnects a toothpaste engaging platform member and a hand engaging platform member. A pair of ring toothbrush engaging members is secured to the sides of the toothpaste dispenser for releasably supporting a toothbrush. A fastener is connected to the rear wall of the toothpaste dispenser for securing the toothpaste dispenser to an upright surface, such as a wall in a bathroom.

6 Claims, 3 Drawing Sheets

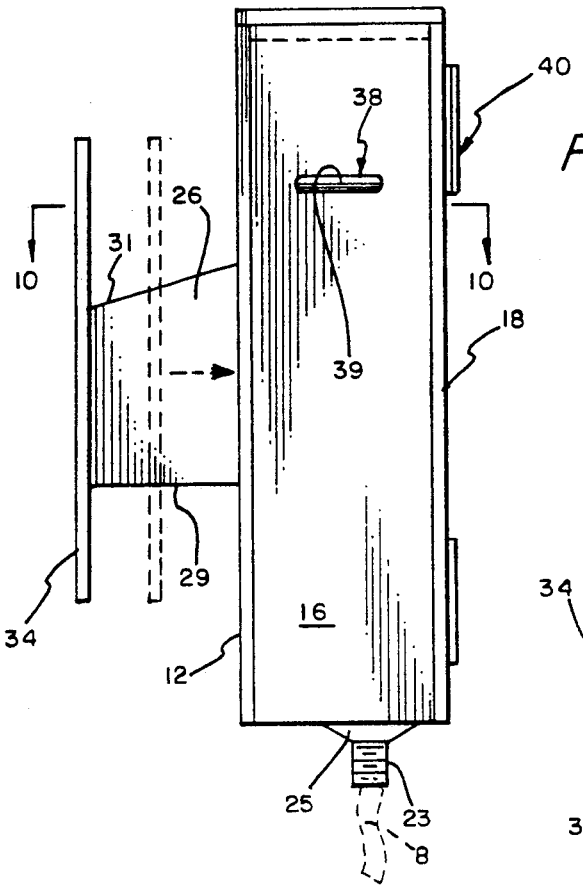
FIG. 4
FIG. 5
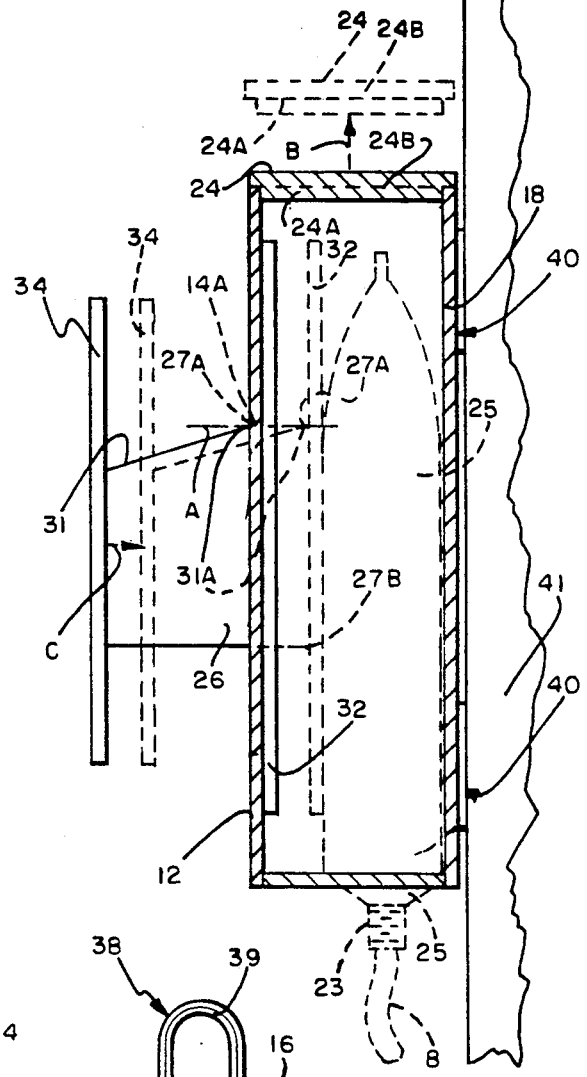
FIG. 6
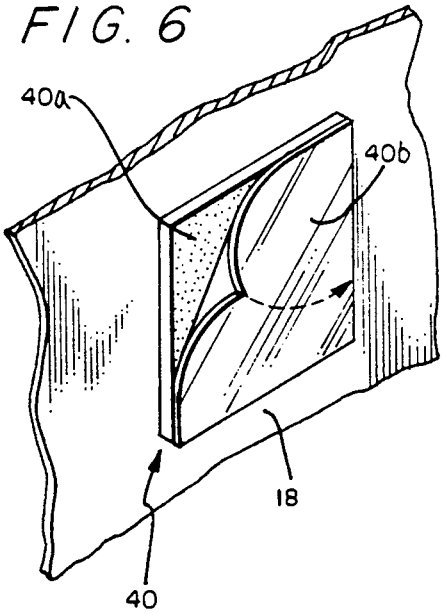
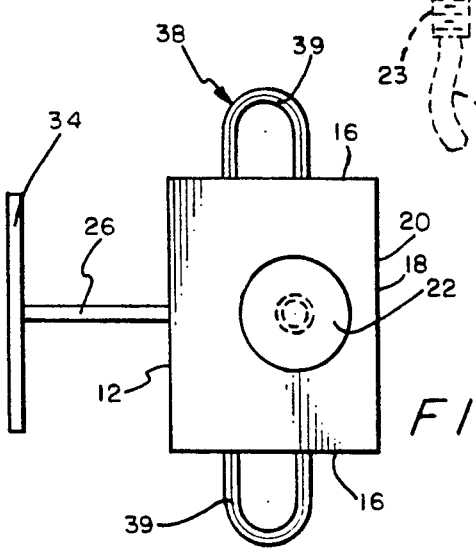
FIG. 7

APPARATUS FOR DISPENSING TOOTHPASTE FROM A FLEXIBLE TUBE

FIELD OF THE INVENTION

This invention is related to toothpaste dispenser. More specifically, the present invention provides a toothpaste dispenser that is capable of dispensing toothpaste from a toothpaste container.

DESCRIPTION OF THE PRIOR ART

A patentability investigation was conducted and the following United States patents by numbers were discovered: 2,596,683 to Hawkins; 3,405,843 to Watson, Jr.; 3,701,459 to Ward; 3,946,904 to Mulakala; 4,450,982 to Ferreira; 4,548,337 to Morris; 4,565,303 to Gilbertson; 5,035,347 to Trovo; and 5,105,984 to Kazimir. None of the foregoing prior art U.S. patents teach or suggest the particular toothpaste dispenser of the present invention.

SUMMARY OF THE INVENTION

The present invention accomplishes its desired objects by broadly providing a toothpaste dispenser comprising a top which has a structure defining a generally centrally disposed elongated opening. The toothpaste dispenser also includes a pair of sides secured to the top, a rear wall secured to the sides, and a first end wall secured to the top, to the sides, and to the rear wall. The first end wall has an opening wherethrough a neck of a toothpaste container may pass. The toothpaste dispenser also includes a second end wall removably engaged to the top, to the sides, and to the rear wall such that when the second end wall is removed, a toothpaste container may be disposed into the toothpaste dispenser. A lug member is provided with a lug bottom and a lug top. The lug member slidably passes through the elongated opening of the top. A toothpaste container engaging platform member is secured to the lug bottom; and a hand engaging platform member is secured to the lug top. At least one toothbrush engaging means is secured to one of the sides for releasably holding a toothbrush. A fastening means is engaged to the rear wall of the toothpaste dispenser for securing the toothpaste dispenser to an upright surface, such as a wall in the bathroom.

It is therefore an object of the present invention to provide a toothpaste dispenser.

These, together with the various ancillary objects and features which will become evident to those skilled in the art as the following description proceeds, are attained by this novel toothpaste dispenser, a preferred embodiment being shown with reference to the accompanying drawings, by way of example only, wherein:

BRIEF DESCRIPTION

FIG. 4 is a side elevational view of the toothpaste dispenser;

FIG. 5 is a vertical sectional view taken in direction of the arrows and along the plane of line 5—5 in FIG. 2;

FIG. 6 is a partial perspective view of the rear wall of the toothpaste dispenser having and depicting a fastening means which is for mounting the toothpaste dispenser in an upright position on an upright surface such as a wall;

FIG. 7 is a bottom plan view of the toothpaste dispenser;

DETAILED DESCRIPTION OF THE INVENTION

Figure 1:
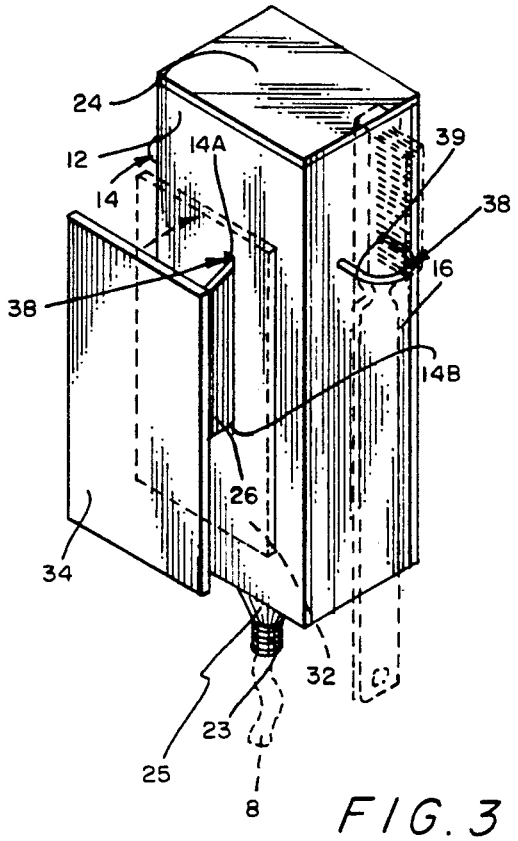
FIG. 1 is a perspective view of the toothpaste dispenser containing a toothpaste container and supporting a toothbrush represented as a dotted line.
Figure 2:
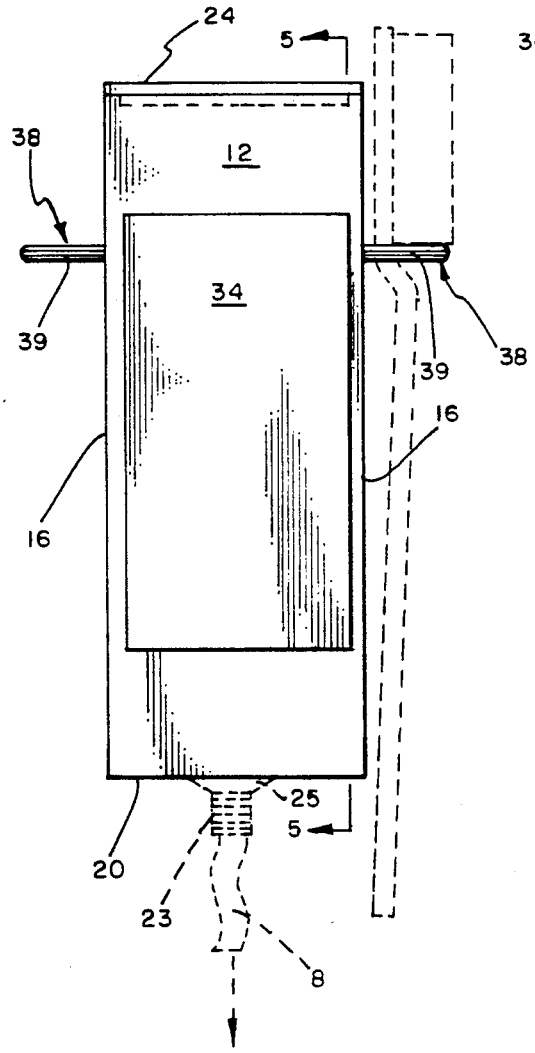
FIG. 2 is a front elevational view of the toothpaste dispenser of FIG. 1.
Figure 3:
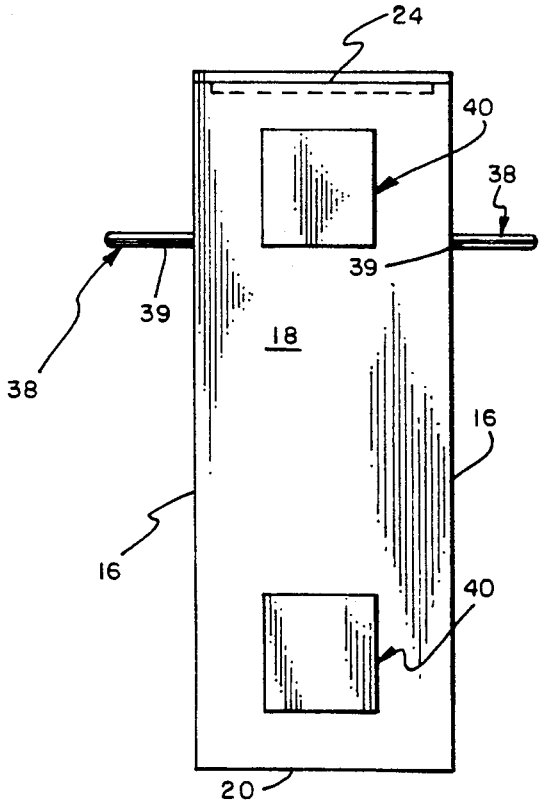
FIG. 3 is a rear elevational view of the toothpaste dispenser of FIG. 1.

Reviewing in detail now to the drawings wherein similar parts of the invention are identified by like reference numerals, there is seen a toothpaste dispenser, generally illustrated as 10. The toothpaste dispenser includes a top 12 having a structure with a centrally disposed elongated opening 14. Opening 14 has a pair of opposed ends 14*a* and 14*b*. A pair sides 16—16 is secured to the top 12. A rear wall 18 is secured to the sides 16—16; and a rear end wall 20 is secured to the top 12, to the sides 16—16, and to the rear wall 18. The rear end wall 20 has an opening 22 wherethrough a neck 23 of a toothpaste container 25 may pass such that toothpaste 8 may be dispensed.

The toothpaste dispenser 10 also includes a second end wall 24 removably engaged to the top 12, to the sides 16, and to the rear wall 18 for removing the second end wall 24 to dispose the toothpaste container 25 into toothpaste dispenser 10. The second end wall 24 comprises a pair of square or rectangular members 24A and 24B secured to each other. A lug member 26 is provided such as to have a lug bottom 28 and a lug top 30. The lug member 26 slidably passes through the elongated opening 14. A toothpaste container engaging platform member 3 is secured to the lug bottom 28; and a hand engaging platform member 34 is secured to the lug top 30. As least one toothbrush engaging means, generally illustrated as 38, is secured to one of the sides 16 for releasably holding the toothbrush. Preferably, the toothbrush engaging means 38 more specifically includes a pair of ring or semi-circular metallic members 39—39 respectively secured to the sides 16—16 for releasably supporting a toothbrush. A fastening means, generally illustrated as 40, is engaged to the rear wall 18 of the toothpaste dispenser 10 for securing the toothpaste dispenser 10 to an upright surface, such as wall 41 (see FIG. 5). The fastening means 40 is preferably a double-sided adhesive member 40*a* (see FIG. 6) having a substrate 40*b* which is to be pealed off to expose the adhesive member 40*a*.

Figure 10:
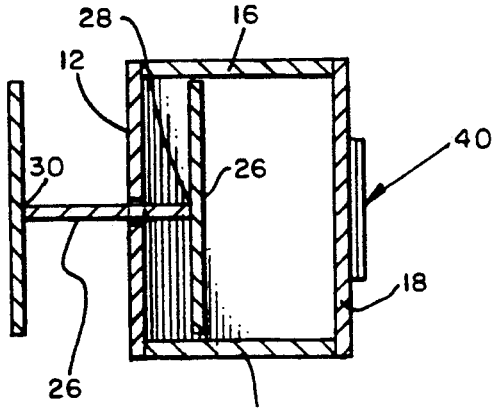
FIG. 10 is a horizontal sectional view of the toothpaste dispenser showing the insides thereof.

The toothpaste container engaging platform member 32 has a width which has a dimension that is slightly less than the distance between the two sides 16—16 (see FIG. 10). More specifically, the width of the toothpaste container engaging platform member 32 is approximately equal to a measurement that ranges from about 90% to about 98% of the distance between the pair of sides 16—16. This is one of the salient features of the present invention in order that the toothpaste container engaging platform member 32 may fully engage the toothpaste container 25 such that when the platform 32 contacts the toothpaste container it is in a flushed contact with the entire width of the toothpaste container 25 in order that the platform member 32 may completely push, depress or otherwise remove all of the toothpaste 8 from the toothpaste container 25 before the second end wall 24 has to be removed for removing a generally empty toothpaste container 25.

Another salient feature of the present invention is that the toothpaste container engaging platform member 32 has a length that has a measurement that ranges from about 90% to about 98% of the length of the toothpaste container 25 such that essentially the entire body of the toothpaste container is engaged by the toothpaste engaging platform member 32. This salient feature also provides for an assurance that the platform member 32 may entirely dispense, discharge, or otherwise remove, all of the toothpaste 8 from the toothpaste container 25 before the second end wall 24 has to be removed to remove the toothpaste container 25 from the toothpaste dispenser 10.

Figure 8:
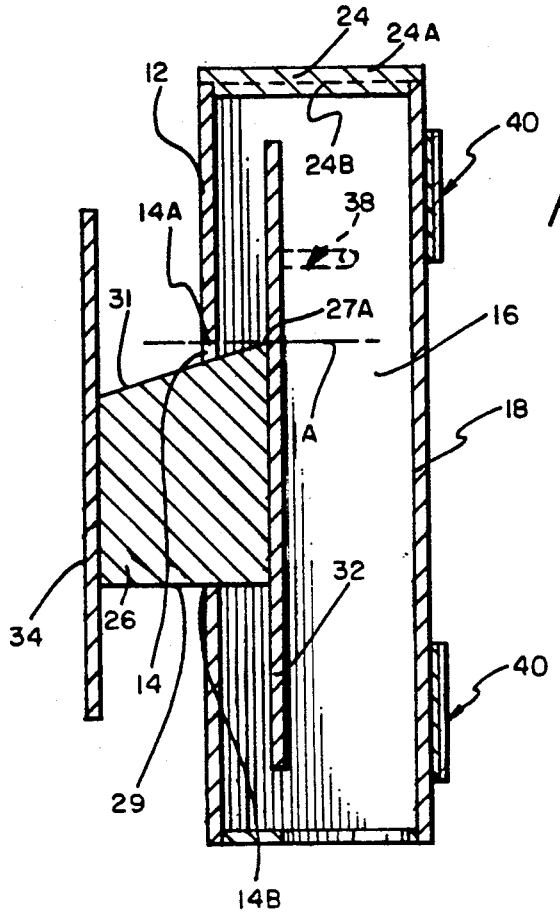
FIG. 8 is a vertical sectional view of the toothpaste dispenser disclosing the insides thereof.
Figure 9:
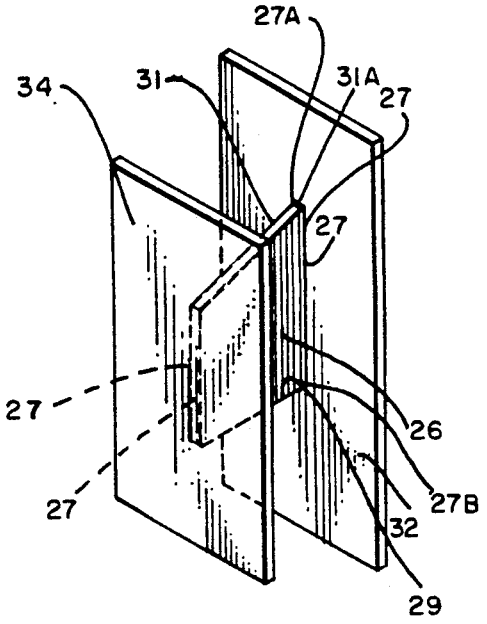
FIG. 9 is a perspective view of the toothpaste container engaging platform interconnected to a hand engaging platform by a lug member.

The lug member 26 (or yoke member) has a generally trapezoidal shape which is yet another salient feature of the present invention. The lug member 26 has a parallel ends 27—27 which respectively secure to the toothpaste container engaging platform member 32 and to the hand engaging platform member 34. The lower parallel end 27 has opposed edges 27A and 27B. The lug member 26 also has a pair of non-parallel sides 29 and 31. Side 31 has an edge 31A which is common with edge 27A. The side 29 (as best shown in FIG. 5) is essential normal to the parallel ends 27—27. The side 31 is an angular disposed side with respect to the parallel ends 27—27 and is not parallel to side 29. The angular disposement of the side 31 with respect to the ends 27—27 is important such that when the hand engaging platform member 34 is depressed downwardly (see FIG. 5), the toothpaste engaging platform member 32 pushes against the toothpaste container 25 while the angularly disposed end 31 may readily pass through the opening 14 such that the opposed edges 31A and 27A may travel in a common plane A with end 14A of the opening 14. More specifically, as best shown in FIGS. 5 and 8, as the lug member 26 travels towards the toothpaste container, the edges 31A and 27A of the lug member 26 travels in the plane A which is generally horizontal with a plane of or along the end 14A of the opening 14. Stated alternatively, a plane along the end 14A (of the opening 14) and of the edges 31A and 27A of the lug member 26 is generally the common plane or the horizontal plane A such that when the lug member 26 is extended entirely away from the top member 12 (or the hand engaging platform member 34 is disposed at its greatest possible distance away from top 12), the edges 31A and 27A is generally in close proximity or in contiguous contact with the end 14A of the opening 14 (as best shown in FIG. 5).

The second end member 24, as previously indicated, is removably disposed against the top 12, the rear wall 18, and the pair of sides 16—16 (see FIGS. 5 and 8). The second end wall 24 may be defined by the pair of square or rectangular members 24A and 24B which are secured to each other in a superimposedly relationship. The member 24A basically is demensioned to snugly pass into the toothpaste dispenser 10 such that the perimetrical edges of the member 24A is in frictionally slidably contact with the inside surfaces of the top 12, the sides 16—16, and the rear wall 18. The member 24B is dimensioned such that the perimetrical distance around its border is essentially the same as the perimetrical distance around the entire toothpaste dispenser 10 in order that when the second end member 24 is securely secured to dispenser 12, the perimetrical edges of the member 24B collimates or align with the outside surfaces of the top 12, the sides 16—16, and the rear wall 18. As best shown in the dotted line position in FIG. 5, the second end member 24 may be removed from the toothpaste dispenser 10 in direction of the arrow B set forth in FIG. 5. When the second end member 24 is slidably and frictionally in engagement with the toothpaste dispenser 10, the member 24A seats into the inside of the dispenser 10 and the member 24B is flushed against the outside surfaces of top 12, the sides 16—16, and the rear wall 18. When the hand engaging platform member 24 is depressed in direction of the arrow C extending therefrom in FIG. 5, the toothpaste container engaging member 32 comes in contact with the toothpaste container 25 such that the continually downwardly exertion or urging force against the platform 34 causes toothpaste 8 to leave the toothpaste container 25, as best shown in the dotted line configuration in FIG. 5.

Thus by the practice of the present invention there is provided a dispenser 10 which is to dispense from a tube or container 25 containing a toothpaste 8. It is to be understood that the spirit and scope of the present invention may include other containers or tubes which contained other viscous fluids such as hair cream, hand cream, artist's oil paints, and numerous other items which may be contained in a tube. The toothpaste container 10 may dispense any viscous material contained in the container 25. It may be mounted on the wall in a bathroom above or near the lavoratory for toothpaste or hair cream; and above or near the wall adjacent to a kitchen sink for hand cream. The dispenser 10 may also be mounted above a work bench for dispensing glue, etc. The container 10 is ready to dispense fluid after the lug member is pulled at its greatest distance from the top 12 of the dispenser until the member 32 is flushed against the bottom of the top 12. The end member 24 is removed and the container 25 is vertically disposed into the dispenser 10 such that the neck 25 extends through the opening 22. The end 24 is subsequently engaged back onto the dispenser 10. The dispenser 10 may be constructed of any durable material such as plexi-glass, plastic (polyethelene, polypopelene, etc.), or any other durable material which is preferably of an aesthetic nature.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A toothpaste dispenser (10) comprising a top (12) having a structure defining a generally centrally disposed elongated opening (14) with an opening defined length and having a first opening end (14A) with a plane (A) and a second opening end (14B); a pair of sides (16—16) secured to said top (12); a rear wall (18) secured to said sides (16-16); a first end wall (20) secured to said top (12), said sides (16-16), and said rear wall (18); said first end wall (20) having an opening (22) wherethrough a neck of toothpaste container may pass; a second end wall (24) removably engaged to said top (12), said sides (16—16) and said rear wall (18) for removing the second end wall (24) to dispose a toothpaste container into the toothpaste dispenser; a generally trapezoidal shaped lug member (26) having a first lug side (28) terminating in a first lug side end (27A) and in a second lug side end (27B), a second lug side (30) parallel to said first lug side (28), a first lug end (29) perpendicularly positioned with respect to said first and said second lug sides (28 and 30), and a second lug end (31) having a second lug end edge (31A) which is common with said first lug side end (27A) and said second lug end (31) being angularly disposed with respect to said parallel first and second lug sides (28 and 30) and not parallel to said first lug end (27), said angular disposement of said lug end (31) being such that said lug member (26) slidably passes through said elongated opening (14) with said first lug side end (27A) and said second lug end edge (31A) travelling along said plane (A) and with said first lug end (29) travelling in contiguous contact with said second opening end (14B), and said second lug end (31) slidably passing through said elongated opening (14) such that any point on said second lug end (31) is capable of moving farther and farther away from said first opening end (14A); a toothpaste container engaging platform member (32) secured to said first lug side (28); a hand engaging platform member (34) secured to said second lug side (30) such that as said hand engaging platform member (34) is being pushed downwardly for the toothpaste container engaging platform member (32) to push against a toothpaste container (25), any part on the second lug end (31) moves farther away from said first opening end (14A) and the first lug side end (27A) and the second lug end edge (31A) travel in said plane (A) and said first lug end (29) travels in contiguous contact with said second opening end (14B); at least one toothbrush engaging means (38) secured to one (16) of said sides (16—16) for releasably holding a toothbrush; and a fastening means (40) engaged to the rear wall (18) of the toothpaste dispenser (10) for securing the toothpaste dispenser (10) to an upright surface.

2. The toothpaste dispenser of claim 1 wherein said first lug side (28) has a first lug side length, and said second lug side (30) has a second lug side length that is less than said first lug side length.

3. The toothpaste dispenser of claim 1 wherein said second end wall comprises a pair of generally rectangular members secured to each other in a superimposedly relationship; one of said rectangular members having a perimeter that is essentially identical to a perimeter of the toothpaste dispenser (10) and the other of said rectangular member having a perimeter that is essentially about equal to or a little less than the inside perimeter of said toothpaste dispenser (10).

4. The toothpaste dispenser of claim 3 wherein said toothpaste container engaging platform member (32) has a width that is approximately equal to a measurement that ranges from about 90% to about 98% of a distance between said sides (16—16), and a length that has a measurement that ranges from about 90% to about 98% of a length of a toothpaste container (25) which is to be disposed within a toothpaste dispenser (10).

5. The toothpaste dispenser of claim 4 wherein said toothbrush engaging means (38) comprises a pair of ring members (39—39) secured to the sides (16—16) for releasably holding a toothbrush.

6. The tooth paste dispenser of claim 5 wherein said first lug side (28) has a first lug side length, and said second lug side (30) has a second lug side length that is less than said first lug side length.

* * * * *